United States Patent [19]

Lebecque

[11] 4,336,519

[45] Jun. 22, 1982

[54] MAGNETIC ELECTRICAL CONTACT SYSTEMS

[76] Inventor: Maurice G. N. G. Lebecque, 9125 Wiltshire Pl., Burnaby, British Columbia, Canada, V3L 4N6

[21] Appl. No.: 176,329

[22] Filed: Aug. 8, 1980

[51] Int. Cl.[3] ..... H01H 36/00

[52] U.S. Cl. ..... 335/206; 46/259; 191/18

[58] Field of Search ..... 335/206, 205, 207; 307/115, 140; 191/15, 16, 17, 18, 19, 13, 20; 339/12 R; 46/251, 259; 273/238, 239

[56] References Cited

U.S. PATENT DOCUMENTS 771,785 10/1904 Lowrie ..... 191/19
2,966,561 12/1960 Durant ..... 335/206

FOREIGN PATENT DOCUMENTS 47896 7/1889 Fed. Rep. of Germany ..... 191/18
1875 of 1909 United Kingdom ..... 191/18

*Primary Examiner*—Harold Broome
*Attorney, Agent, or Firm*—Townsend and Townsend

[57] ABSTRACT

A magnetic electrical contact system comprising first and second electrical members connected in two different electrical circuits. One of these members is a power member and the other member a pick-up member. A plurality of closely spaced plungers are mounted at the surface of one member and are movable between a normal inoperative position and an operative position. As the pick-up member is moved over the surface of the power member, plungers engaged by the pick-up member are moved thereby to their operative positions. When a plunger is in its operative position the electrical circuit of one member is connected to that of the other member.

23 Claims, 9 Drawing Figures

MAGNETIC ELECTRICAL CONTACT SYSTEMS

Figure 1:
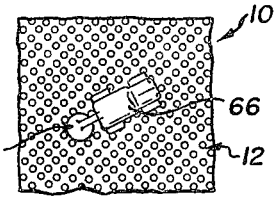

This invention relates to magnetic electrical contact systems which have many useful purposes.

These systems are primarily for use where a pick-up member is moved over the surface of a power member. The systems may be relatively small for use with toys, such as toy vehicles, or they may be used on a larger scale for use by working vehicles such as passenger buses or trams. However, the systems can be used to provide electrical outlets for different things, such as electrical appliances, whereby the electrical pick-up member connected to the appliance can be shifted to different positions on an elongate power member.

In some electric railway systems, a power rail runs along the tracks from which electrical power is picked up. However, this is a constant danger since the power rail can be contacted by pedestrians or animals. Some electric railways and bus systems have overhead wires from which the electrical power is picked up by trolleys. As is well known, the trolleys frequently come off the overhead wires, and the latter require considerable maintenance. Furthermore, vehicles such as trolley buses must move along relatively narrow paths. Another disadvantage is that one vehicle cannot pass another in either direction while utilizing the same overhead wires.

The electrical contact systems of the present invention make it possible for a vehicle, such as a toy car or the like, to move horizontally in all directions. Some of these systems can be used in place of overhead wires, in which case the vehicle has more freedom for lateral movement than trolley buses, and there is no danger of the pick-up member accidentally coming away from the power member. These systems will allow one vehicle to pass another vehicle going forward or backward without breaking contact with the power source. It is also possible to use these systems for vehicles or boats on water. Furthermore, if some of the present systems are used in place of a power rail, it is practically impossible for a pedestrian or animal coming into contact with the power member to be harmed.

A contact system in accordance with this invention is basically relatively simple. It consists of a power member for supplying the electrical power, and a pick-up member for movement over the power member, said pick-up member being attached to the article, such as a vehicle, requiring electrical power for operation. In a preferred form of the invention, a plurality of closely spaced plungers are mounted in the power member and have outer ends near the surface thereof. The pick-up member has a magnet therein which, when the member is moved over the power member, attracts plungers over which the pick-up member moves towards the latter. This connects a power circuit of the article to a power supply circuit of the power member. With this arrangement, the article and its pick-up member can move in any direction over the power member within the bounds of the latter.

The power member can be located below the article or it can be located above the latter. In another variation of the invention, the power member may be in the form of a bar and the pick-up member may be connected to an electrical appliance.

A magnetic electrical contact system according to the present invention comprises a first electrical member comprising a surface with a plurality of closely spaced holes opening outwardly therefrom, a plunger movably mounted in the first member in each hole thereof and movable longitudinally between a normal inoperative position and an operative position, first electrical circuit means, and first contact means on each plunger to form part of the first circuit when said each plunger is moved from the normal position thereof; and a second electrical member to be moved over the surface of the first member and adapted to move the plunger of at least one hole at a time away from its normal position, said second member comprising second electrical circuit means, and second contact means forming part of the second circuit means to be engaged by the first contact means of any plunger moved to the operative position thereof, whereby said first circuit means is electrically connected to said second circuit means when a plunger of the first member is moved to its operative position.

More specifically, the contact system may comprise a first electric member comprising a surface with a plurality of closely spaced holes opening outwardly therefrom, a plunger movably mounted in the first member in each hole thereof and movable longitudinally between a normal inoperative inner position within said member and an outer operative position projecting from its respective hole outwardly from the first member, said plunger being attractable by a magnet, first electric circuit means, and first contact means on each plunger to form part of the first circuit when said each plunger is moved from the normal position thereof; and a second electrical member to be moved over the surface of the first member and comprising a magnet positioned to attract the plunger of at least one hole at a time from its normal position to its operative position, second electric circuit means, and second contact means forming part of the second circuit means, whereby said first circuit means is electrically connected to said second circuit means when the magnet of the second member attracts a plunger of the first member to the operative position thereof.

Figure 2:
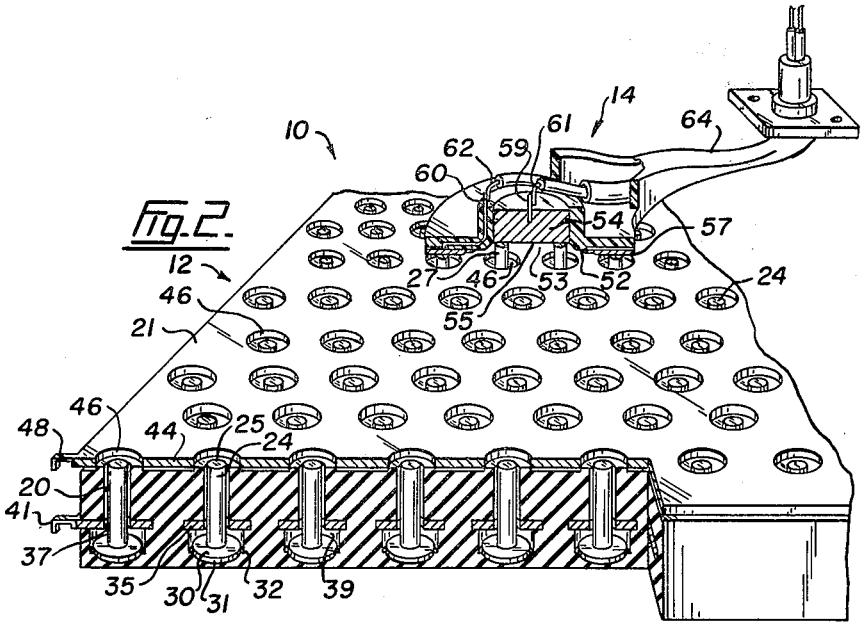
Figure 3:
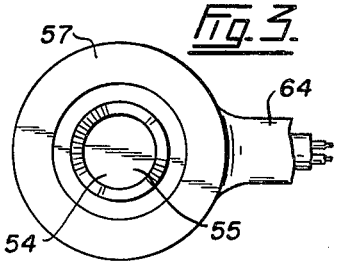
Figure 4:
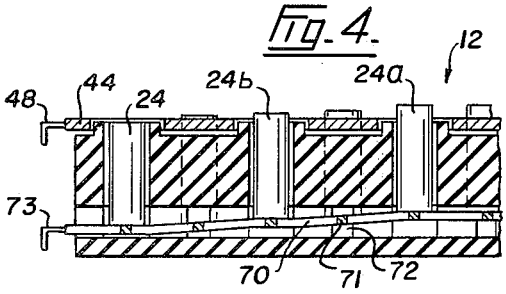
Figure 9:
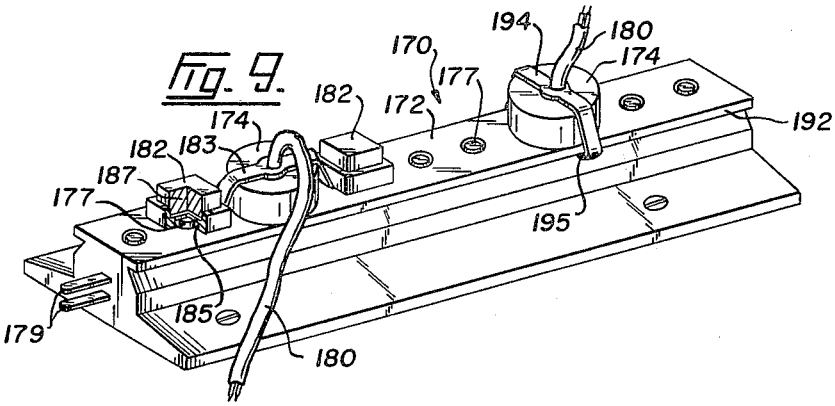
Figures 5, 7:
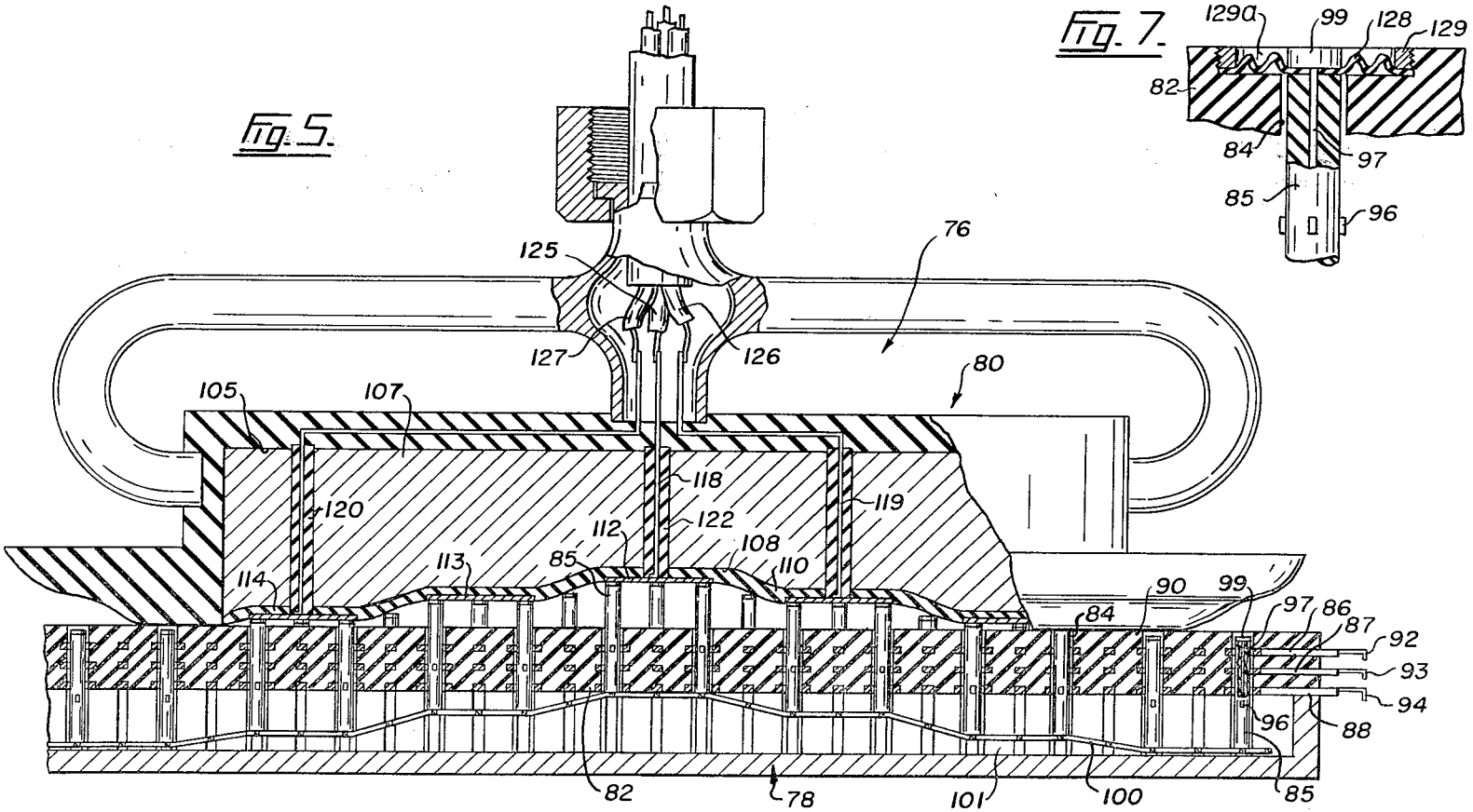
Figure 6:
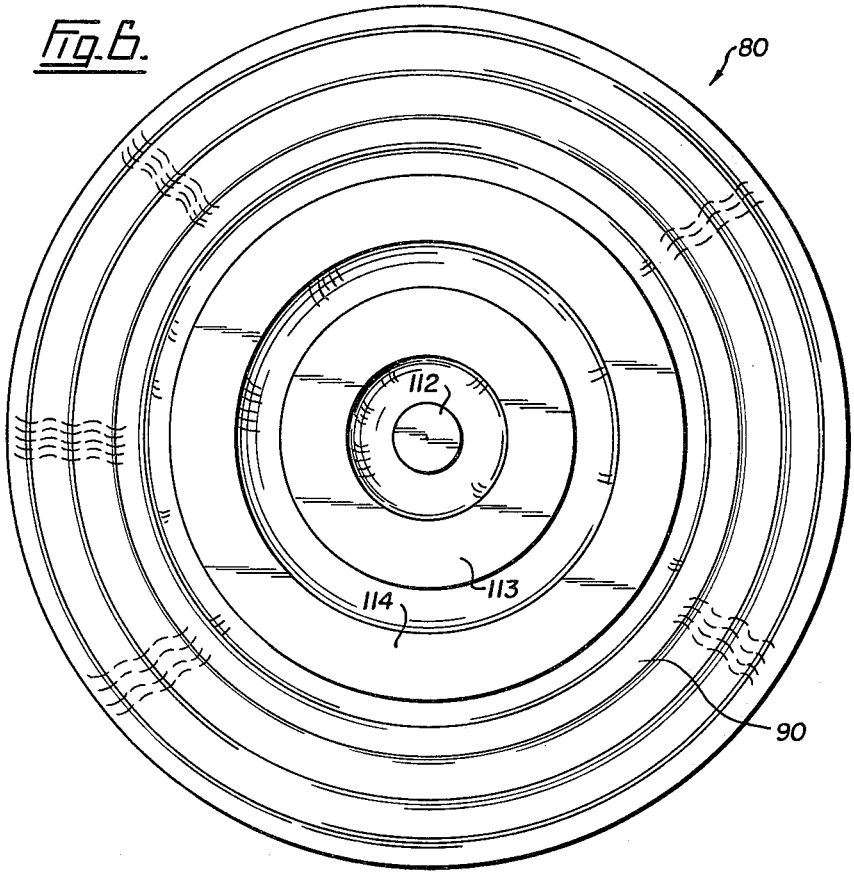
Figure 8:
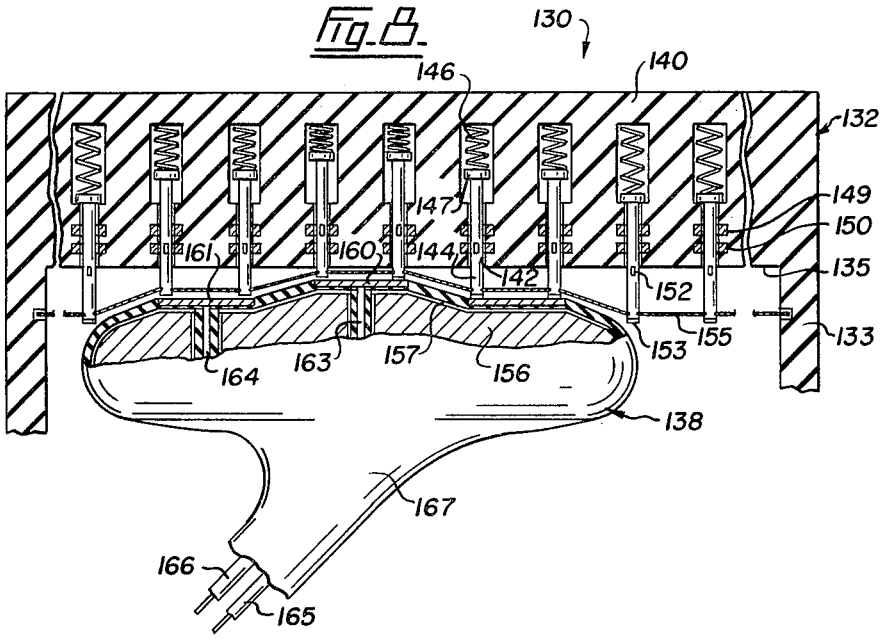

Examples of this invention are illustrated in the accompanying drawings, in which:

FIG. 1 is a reduced plan view of a preferred form of the invention,

FIG. 2 is a perspective view on a larger scale and partly in section of the apparatus illustrated in FIG. 1, FIG. 3 is a bottom plan view of the pick-up member of the apparatus of FIG. 1, FIG. 4 is a section through a variation of the apparatus of FIG. 1, FIG. 5 is an enlarged cross section through an alternative form of the invention, FIG. 6 is a bottom plan view of the pick-up member of the apparatus of FIG. 5, FIG. 7 is an enlarged detailed view of a plunger having a sealing arrangement near its outer end, FIG. 8 is a section through another alternative form of the invention, and FIG. 9 is a perspective view of still another form of the invention, and illustrating two variations of this form.

Referring to FIGS. 1 to 3 of the drawings, 10 is a magnetic electrical contact system or apparatus in accordance with this invention. The apparatus 10 includes cooperating electrical members 12 and 14. In this example, 12 is a power member and 14 is a pick-up member. Actually, for some purposes, this could be reversed, that is, 14 could be the power member and 12 the pick-up member. In the illustrated example, the member 14 rests on and is movable over member 12, but, if desired, member 12 could be above and member 14 pressed upwardly against it.

Member 12 is preferably formed of a non-conducting material, and it has a plurality of closely spaced holes or bores 20 therein and opening outwardly from the upper surface 21 thereof. A plunger 24 is slidably mounted in each hole 20 and is movable between a normal inner position at which time the outer end 25 of the plunger is located at the surface of the member, and an operative or outer position at which time said outer end extends above the member surface as indicated at 27 in FIG. 2. Each plunger 24 has a contact 30 at its inner end 31, said contact being in the form of a laterally-extending flange. The inner end 31 of the plunger rests on a bottom 32 of the hole 20 in which the plunger is located when said plunger is in its normal position.

Circuit means is provided for member 12, and this circuit means is connectable to a source of electrical power. This circuit means includes a conductor plate or grid 35 in member 12 extending substantially parallel with and spaced from surface 21 of the member. This conductor plate has a hole 37 therein registering with each bore 20 of the member, and each hole 20 is formed with an enlarged section 39 below plate 35 so that when the plunger is moved to its operative position, contact flange 30 engages the conductor plate. The conductor plate is provided with a terminal 41 to which a wire from an electrical source can be connected.

The power member 12 is preferably provided with a conducting plate 44 on the surface 21, said conducting plate constituting the working surface of the power member. The conducting plate 44 has a hole 46 therein registering with each hole or bore 20. It will be noted that each of the aligned and registering holes 20, 37 and 46 is of such diameter that it is clear of the plunger 24 associated with these holes. In other words, each plunger is electrically insulated from the conductor plate 35 and the conducting plate 44. The latter plate has a terminal 48 to which a wire can be connected. The wires connected to terminals 41 and 48 are respectively connected to plates 37 and 44 and form opposite sides of an electrical power circuit.

Plates 35 and 44 are formed of suitable electrical conducting material such as copper. Each plunger 24 is attractable by a magnet, and in this example, each plunger is formed of iron so that it can also act as an electrical conductor.

Pick-up member 14 is formed of suitable non-conducting material, such as a plastic material, and may be of generally circular configuration. This member has a flat lower surface 52 with a central cavity 53 therein in which is positioned a magnet 54 having a lower surface 55. This lower surface is spaced a little above the member surface 52. An annular contact or collector plate 57 is mounted on member surface 52 and surrounds cavity 53 and is spaced from magnet 54. This magnet and the contact plate are provided with terminals 59 and 60 respectively adapted to be connected to wires 61 and 62. The magnet and contact plate together with wires 61 and 62 form opposite sides of an electrical circuit leading to an article requiring electrical power for operation. It will be noted that magnet 54 is large enough to span two holes 46 of conducting plate 44 of the power member so that it can attract two plungers 24 at a time. However, the magnet can be small enough to attract only one plunger as it moves over the hole thereof, or large enough to attract several plungers. Contact plate 57 is in constant sliding engagement with conducting plate 44 of the power member.

In this example, pick-up member 40 has an arm 64 connected thereto said arm extending to an article, such as a toy vehicle 66, see FIG. 1, to which said arm is attached. This toy vehicle may have an electrical driving motor, and may have controls and radio means such that it can be remotely controlled.

As vehicle 66 moves over the surface of power member 12, it picks up electrical power through the head or pick-up member 14. As this member 14 moves over the base or power member, magnet 54 attracts one or more plungers therebeneath to their operative or outer positions, at which time the contacts 30 of these plungers engage the conductor plate 35 so that the plungers act as switches which are closed at this time. This action electrically connects the electrical circuit of member 12 to the electrical circuit of pick-up member 14 and thereby to the power unit and controls of vehicle 66.

As plungers 24 are closely spaced throughout the top area of member 12, vehicle 66 can travel in any direction on the power member since there will always be at least one plunger attracted by the magnet of the pick-up member.

If DC current is used, conducting plate 44 and contact plate 57 can be eliminated, it only being necessary to ground the source of power and the toy vehicle. However, it is preferable to use plates 44 and 57 even if DC current is used. In this case, either the plate 35-plunger 24-magnet 55 or the conducting plate 44-contact plate 57 is a ground circuit.

FIG. 4 illustrates a variation of the invention of FIGS. 1, 2 and 3. In this example, the contact flange 30 of each plunger 24 and the conductor plate 35 are omitted. Instead of this, a web 70 formed of conducting material is connected to the lower or inner end of each plunger 24. Web 70 is made up of criss-crossed conductors 71 which extend through channels 72 in member 12 at the lower ends of the plungers. This web has a terminal 73 to which an electric wire can be connected.

Web 70 normally lies flat in power member 12, but when a plunger, such as plunger **24*a* in FIG. 4, is attracted to its operative position by the magnet of the pick-up head, the portion of the web connected to this plunger is raised. This tends to lift the adjacent plungers, such as plunger 24*b*, towards their operative or outer positions so that they are closer to the magnet when the latter moves over them to attract them out to their operative positions. When the plunger is released by the magnet, web 70** assists in moving it back towards its normal position.

FIGS. 5 and 6 illustrate an alternative system or apparatus 76 which is usually used with larger articles, such as transit vehicles. The apparatus 76 can be used in two-wire electrical circuits, or in three-wire circuits, as shown. Apparatus 76 includes a power member 78 and a pick-up member or head 80 adapted to be moved over the power member. Member 78 is in the form of a base 82 formed of non-conducting material, this base having closely spaced holes or bores 84 therein in each of which is located a plunger 85 movable between an inner normal position and an outer operative position. In this example, three conductor plates or grids 86, 87 and 88 are located in base 82, are parallel to each other and to the top surface 90 of the base, and spaced from each other and said surface. The plates 86, 87 and 88 are provided with terminals 92, 93, and 94, respectively, to be connected into a three-wire electrical circuit. Each plunger 85 is attractable by a magnet, and has a contact 96 projecting laterally therefrom which, when the plunger is in its normal position, is located below the lowermost conductor plate 88. The contact 96 of each plunger is electrically connected by a wire 97 to another contact 99 on the outer end of the plunger, see the plunger shown near the right side of FIG. 4. If desired, the plungers 85 can be interconnected at their lower ends by a non-conducting web 100 lying in channels 101 in the base 82.

The pick-up head or member 80 is relatively large, and is formed with a large cavity 105 opening downwardly therefrom. A large magnet 107 is mounted in this cavity and has a substantially concave lower surface 108. The bottom of the magnet has a cover 110 formed of non-conducting material thereon. The pick-up member or head is provided with three contact or collector plates 112, 113 and 114 mounted on the bottom of the magnet with the cover 110 therebetween. Contact plate 112 is circular and is located centrally of the bottom of the magnet, while contact plates 113 and 114 are of annular configuration and are concentric with plate 112, all of said plates being spaced from each other. Conductor plates 86, 87, and 88 of power member 78 are located at different levels therein, and contact plates 112, 113 and 114 are located at corresponding different levels in member 80. With this arrangement, when a plunger 85 is attracted by magnet 107 to its outer or operative position in engagement with contact plate 112, the contact 96 of said plunger is in engagement with conductor plate 86. Similarly, when the magnet attracts a plunger outwardly into engagement with contact plate 113, the plunger contact 96 thereof is in engagement with conductor plate 93, and when a plunger is attracted into engagement with contact plate 114, its contact 96 is in engagement with conductor plate 88.

Contact plates 112, 113 and 114 are connected to conducting wires 118, 119 and 120, respectively, which extend upwardly through magnet 107 and are insulated therefrom by insulating sleeves 122, said conductors being respectively connected to wires 125, 126 and 127 which extend out of the pick-up head to the article requiring power.

It will be noted that several plungers 85 are attracted to each of the contact plates 112, 113, and 114 at a time, and that there are plungers in engagement with the three plates at the same time. Thus, when the pick-up member 80 moves over the surface of the power member 78, there are always plungers in engagement with the contact plates 112, 113 and 114 which electrically connect these contact plates with conductor plates 86, 87 and 88, respectively so that the electrical circuit means of the pick-up head is electrically connected to the electrical circuit means of the power member. The annular contact plate 114 is the closet of the three contact plates to the surface of power member 78, and therefore the surface of the magnet at contact plate 114 is very close to the power member surface. As a result, the electrical attraction of magnet 107 for the plungers beneath plate 114 is relatively strong. When these plungers are attracted towards the contact plate, web 100 helps to move adjacent plungers under contact plate 113 towards the latter plate, and this in turn, helps to move the plungers under contact plate 112 towards the latter.

A sealing arrangement can be provided for each of the plungers described above, and FIG. 7 illustrates a plunger 85 of apparatus 76 by way of example with one form of sealing arrangement. In this example, the plunger 85 has a flexible seal 128 secured thereto near its outer end, said seal being in the form of a flexible disc through which the outer end of the plunger projects. Disc 128 is formed of non-conducting material, such as rubber, plastic, canvas or the like. This sealing disc is secured around its periphery to the base 82 in any suitable manner, such as by ring 129 threaded into a recess **129*a* formed in the base at the upper end of the hole 84 in which said plunger is located. This sealing disc covers hole 84 while allowing movement of plunger 85**.

FIG. 8 illustrates an alternative form of contact system or apparatus 130 which is primarily design for overhead use. The electrical system of this apparatus is similar to that of apparatus 76 excepting that it is shown as a two-wire system, but it can be a three-wire system, if desired. In this example, a power member 132 is mounted on uprights 133 and faces downwardly, that is, it has a working surface 135 along the bottom thereof. A pick-up head or member 138 is movable over this surface 135.

Power member 132 is made up of a base 140 formed of insulating material and has closely spaced holes 142 therein and opening outwardly through surface 135, each hole having a plunger 144 operatively mounted therein. Another difference in this form of the invention is that the plungers are normally in their outer positions and are movable inwardly towards their operative positions. Each plunger is maintained in its normal position by a spring 146 which bears against a stop head 147 on the inner end of the plunger. Spaced and parallel conductor plates or grids 149 and 150 are spaced from and parallel with the base surface 35. Each plunger has a lateral contact 152 adapted to be moved into engagement with conductor plate 149 or conductor plate 150. Each contact 152 is electrically connected to another contact 153 on the outer end of its plunger. A web 155 interconnects the outer ends of the plungers 144 and extends to the supports or standards 133. This web is non-conducting and is preferably formed of heavy canvas, rubber or flexible plastic so that it acts as a weather shield.

The pick-up member 138 is hollow and preferably has a magnet 156 therein. This magnet has a substantially convex upper or outer surface 157. The pick-up member also has a central contact plate 160 and an annular contact plate 161 concentric with and spaced outwardly from plate 160. The conductor plates 149 and 150 of power member 132 are at different levels, and the contact plates 160 and 161 are at corresponding different levels. Contact plates 160 and 161 are respectively connected to conductors 163 and 164 which extend through and are insulated from magnet 156 and are connected to wires 165 and 166 extending through an arm 167 which extends to the article requiring power, not shown.

As pick-up member 138 moves along power member 132, contact plate 160 engages plungers 144 of the power member at one level, while contact plate 161 engages plungers at a different level. As the plungers are normally in outer positions, the contact plates move them towards their inner or operative positions. As a result, magnet 156 is not absolutely necessary, but it is preferable to include the magnet since it attracts the plungers to the contact plates to maintain a good electrical contact therebetween.

The overhead system 130 of FIG. 8 may be used for vehicles in the form of boats and the like. If the boats travel on water subject to wave action, the base 140 would be made of a flexible material. The pick-up head 138 would have magnet 156 in order to be sure that the plungers over which the head moves are attracted thereto.

FIG. 9 illustrates still another form of contact system or apparatus 170. This apparatus includes a power member 172 in the form of a bar, and a co-operating pick-up head or member 174 shown towards the left end of the power member. The power member 172 has plungers 177 therein which form part of electrical circuit means as illustrated in any of the previously described forms of the invention. Prongs 179 projecting from an end of the bar or from a back face thereof are insertable in an electric socket for connecting the system to a source or electrical power. The pick-up member 174 is provided with electrical circuit means similar to that of any one of the previously described systems and corresponding to the electrical system of power member 172. An electrical cord 180 is connected to the electrical system of pick-up member 174 and extends to a suitable article, such as an electrical appliance.

The novelty of the system or apparatus of FIG. 9 as compared to the other forms of this invention lies in the method of positioning pick-up member 174 anywhere along power member 172 and retaining said members together in proper electrical relationship. Member 174 is provided with gripping means in the form of at least one latching container 182 connected thereto and insulated therefrom. In this example, there are two diametrically opposite containers 182 formed of suitable non-conducting material. These containers are secured to opposite ends of a strap 183 which is secured to and extends over the outer end of member 174. As the containers 182 are identical, one only will now be described.

Container 182 has an opening 185 in the bottom thereof, and carries a magnet 187 above said opening. When member 174 is placed on member 172 and is located in a desired position thereon, the containers 182 overlie two plungers 177 of the power member and the magnets 187 attract these plungers into the container openings 185 so that member 174 is properly positioned relative to one or more other plungers 177 to make a proper electrical connection. The magnets of the latching containers attracting the plungers 177 holds the pick-up member 174 in its proper place.

FIG. 9 also illustrates an alternative form of gripping means for a pick-up member 174. This gripping means comprises keeper means on one of the members and clamp means on the other. In this example, the keeper means consists of a flange 192 projecting laterally from opposite sides of power member 172 at the working surface thereof, and the clamp means is in the form of a strap 194 secured to and extending over the top of pick-up member 174, said strap being bent into a hook 195 at each end thereof which spans and fits under an adjacent flange 192 when the pick-up member is moved onto and along the surface of power member 172. With this arrangement, it is necessary to shift the pick-up member along the power member until it is positioned where proper electrical connection can be effected between the two members.

I claim:

1. A magnetic electrical contact system comprising
a first electrical member comprising
a surface with a plurality of closely spaced holes opening outwardly therefrom,
a plunger movably mounted in the first member in each hole thereof and movable longitudinally between a normal position and an operative position,
first electrical circuit means, and
first contact means on each plunger to form part of the first circuit when said each plunger is moved from the normal position to the operative position thereof; and
a second electrical member to be moved over the surface of the first member and adapted to move each plunger away from its normal position to its operative position as said second member moves over said each plunger, said second member comprising
second electrical circuit means, and
second contact means forming part of the second circuit means to be engaged by said each plunger when moved to the operative position thereof,
whereby said first circuit means is electrically connected to said second circuit means when said each plunger of the first member is moved to its operative position and into engagement with said second contact means of the second member.

2. A contact system as claimed in claim 1 in which said second member includes a magnet positioned to attract said each plunger towards the second member.

3. A magnetic electrical contact system comprising
a first electrical member comprising
a surface with a plurality of closely spaced holes opening outwardly therefrom,
a plunger movably mounted in the first member in each hole thereof and movable longitudinally between a inner position within said member and an outer operative position projecting from its respective hole outwardly from the first member, said plunger being attractable by a magnet,
first electric circuit means, and
first contact means on each plunger to form part of the first circuit when said each plunger is moved from the normal position thereof; and
a second electrical member to be moved over the surface of the first member and comprising
a magnet positioned to attract each plunger from its normal position to its operative position as said magnet is moved by the first member over the latter plunger,
second electric circuit means, and
second contact means forming part of the second circuit means to be engaged by said attracted plunger,
whereby said first circuit means is electrically connected to said second circuit means when the magnet of the second member attracts a plunger of the first member to the operative position thereof to engage said second contact means.

4. A contact system as claimed in claim 3 in which said surface of the first member comprises a conducting plate over which the second member can move, said conducting plate forming part of the first circuit means and being electrically insulated from the contact means on the plungers, and the second contact means of the second member comprises a contact plate in sliding engagement with the conducting plate, said contact plate forming part of the second circuit means.

5. A contact system as claimed in claim 4 in which each plunger of the first member is a conductor forming part of the first circuit means, and the magnet of the second member forms part of the second circuit means, said magnet being electrically insulated from said contact plate.

6. A contact system as claimed in claim 3 in which the magnet of the second member is large enough to span a plurality of holes of the first member at a time.

7. A contact system as claimed in claim 6 in which said second contact means of the second member comprises at least one collector plate positioned to engage any plunger therebeneath that has been attracted by the magnet to its operative position.

8. A contact system as claimed in claim 3 in which the magnet of the second member comprises a plurality of spaced-apart collector plates electrically insulated from each other, each of said spaced-apart collector plates being positioned to engage any plunger therebeneath that has been attracted by the magnet to its operative position.

9. A contact system as claimed in claim 3 comprising gripping means for securing the second member in engagement with the first member in position where said magnet of the second member attracts at least one plunger of the first member.

10. A contact system as claimed in claim 9 in which said gripping means comprises keeper means on one of said members and clamp means on the other of said members, said keeper means and said clamp means being adapted releasably to secure the first and second members together.

11. A contact system as claimed in claim 9 in which said gripping means comprises a latching container secured to the second member and electrically insulated from the second electric circuit means thereof, said container opening towards the first member, magnetic means in the container, said container and the magnetic means thereof being positioned so that said magnetic means attracts one of the plungers of the first member into the container when another of said plungers is being attracted by the magnet of said second member.

12. A contact system as claimed in claim 3 comprising a flexible web interconnecting inner ends of said plungers, whereby when one plunger is attracted to its outer position, plungers adjacent said one plunger are moved by the web at least partly towards their respective outer positions.

13. A contact system as claimed in claim 5 comprising a conductor plate in the first member substantially parallel to said conducting plate and electrically insulated therefrom, said conductor plate forming part of the first electric circuit means, said conductor plate having a hole therein for each plunger and through which said each plunger extends normally out of contact with the conductor plate, and said first contact means of each plunger comprising a contact on the plunger normally spaced from the conductor plate, said contact engaging the conductor plate when said each plunger is moved towards its outer position.

14. A contact system as claimed in claim 5 comprising a flexible conductor web in the first member interconnecting inner ends of said plungers and electrically insulated from said conducting plate, said web forming part of the first electric circuit means.

15. A contact system as claimed in claim 3 comprising a conductor plate in the first member substantially parallel with said surface thereof and forming part of the first electric circuit means, said conductor plate having a hole therein for each plunger and through which said each plunger extends out of contact with the conductor plate, said contact means of each plunger comprising a first contact on the plunger spaced from an outer end of the plunger and normally spaced from the conductor plate and a second contact on said outer end electrically connected to the first contact, said first contact engaging the conductor plate when said each plunger is moved to its outer position; and the second contact means of the second member comprises a contact plate electrically insulated from the magnet, said contact plate forming part of the second circuit means, and said contact plate being engaged by said second contact of a plunger attracted by the magnet to its outer position.

16. A contact system as claimed in claim 3 comprising a plurality of spaced-apart conductor plates in the first member substantially parallel with and insulated from each other and with said surface of the first member, said conductor plates being located at different levels in the first member, each plate forming part of the first electric circuit means, said conductor plates having aligned holes therein for each plunger and through which said each plunger extends out of contact with the conductor plates, said contact means of each plunger comprising a first contact on the plunger spaced from an outer end of the plunger and normally spaced from the conductor plates and a second contact on said outer end electrically connected to the first contact; and the second contact means of the second member comprises a plurality of laterally-spaced contact plates electrically insulated from each other and from the magnet, there being a contact plate for each of said conductor plates, each of said contact plates forming part of the second circuit means, said contact plates being located at different levels in the second member, there being a contact plate for each of said conductor plates at a level corresponding to the level of said each conductor plate, and the contact plate of each level being engaged by the second contact of any plunger aligned therewith and attracted outwardly by the magnet, and the first contact of each said attracted plunger engaging the corresponding conductor plate at this time.

17. A contact system as claimed in claim 16 in which there are three conductor plates in the first member and three corresponding contact plates in the second member located at three different levels.

18. A contact system as claimed in claims 16 or 17 comprising a flexible web interconnecting inner ends of said plungers, whereby when each plunger is attracted towards its outer position, plungers adjacent said each plunger are assisted by the web in movement towards their respective outer positions, and said web returning unattracted plungers to their normal inner positions.

19. A contact system as claimed in claim 1 in which each plunger projects from the first member and is movable in and out respectively between its normal position and its operative position.

20. A contact system as claimed in claim 19 comprising a conductor plate in the first member substantially parallel with said surface thereof and forming part of the first electric circuit means, said conductor plate having a hole therein for each plunger and through which said each plunger extends out of contact with the conductor plate, said contact means of each plunger comprising a first contact on the plunger spaced from an outer end of the plunger and normally spaced from the conductor plate and a second contact on said outer end electrically connected to the first contact, said first contact engaging the conductor plate when said each plunger is moved inwardly towards its operative position; and the second contact means of the second member comprises a contact plate forming part of the second circuit means, and said contact plate being engaged by said second contact of a plunger moved towards its operative position.

21. A contact system as claimed in claim 19 comprising a plurality of spaced-apart conductor plates in the first member substantially parallel with and insulated from each other, said conductor plates being located at different levels in the first member, each plate forming part of the first electric circuit means, said conductor plates having aligned holes therein for each plunger and through which said each plunger extends out of contact with the conductor plates, said contact means of each plunger comprising a first contact on the plunger spaced from an outer end of the plunger and normally spaced from the conductor plates and a second contact on said outer end electrically connected to the first contact; and the second contact means of the second member comprises a plurality of laterally-spaced contact plates electrically insulated from each other, each of said contact plates forming part of the second circuit means, said contact plates being located at different levels in the second member, there being a contact plate for each of said conductor plates at a level corresponding to the level of said each conductor plate, and the contact plate of each level being engaged by the second contact of any plunger aligned therewith, and the first contact of each said plunger engaging the corresponding conductor plate at this time.

22. A contact system as claimed in claim 20 or 21 comprising a flexible web interconnecting outer ends of said plungers, whereby when each plunger is moved towards its operative position, plungers adjacent said each plunger are assisted by the web in movement towards their respective operative positions.

23. A contact system as claimed in claim 1 or 3 comprising a flexible seal connected to and surrounding each plunger near an outer end thereof, and securing means connecting said seal to the first member to cover the hole in which said each plunger is located.

* * * * *